United States Patent [19]

Wilce

[11] 4,445,244

[45] May 1, 1984

[54] SECTIONAL BOAT JOINT CONSTRUCTION

[76] Inventor: Stephen E. Wilce, P.O. Box 962, Winters, Calif. 95694

[21] Appl. No.: 130,085

[22] Filed: Mar. 13, 1980

[51] Int. Cl.[3] ..... B63B 7/04

[52] U.S. Cl. ..... 114/355 C

[58] Field of Search ..... 9/2 C; 285/97; 277/34.3; 403/5, 319, 316, 331

[56] References Cited

U.S. PATENT DOCUMENTS

| | | | |
|---|---|---|---|
| 2,040,373 | 5/1936 | Green | 9/2 S |
| 2,406,085 | 8/1946 | Link | 9/2 S |
| 2,794,992 | 6/1957 | Metzing | 9/2 S |
| 3,222,076 | 12/1965 | Hollingsworth | 285/97 |
| 3,347,200 | 10/1967 | Mege | 285/97 |
| 3,356,398 | 12/1967 | Nilsson | 403/331 |
| 3,846,859 | 11/1974 | Vertrees | 9/2 S |
| 3,916,468 | 11/1975 | Tetreault | 9/2 S |
| 4,132,490 | 1/1979 | Journée | 403/316 |

FOREIGN PATENT DOCUMENTS

| | | | |
|---|---|---|---|
| 1251176 | 9/1967 | Fed. Rep. of Germany | 9/2 S |
| 1506722 | 8/1969 | Fed. Rep. of Germany | 9/2 S |

*Primary Examiner*—Trygve M. Blix
*Assistant Examiner*—Stephen P. Avila

[57] ABSTRACT

A joint construction for a sectional boat arranged to be assembled from a plurality of hull sections, each of the hull sections having a transversely extending edge portion for abutting engagement with the edge portion of an adjacent hull section with flanges on each of the edge portions arranged for mutual overlapping engagement to define a cavity in which an inflatable bladder is disposed whereby inflation of the bladder returns the flanges in the overlapping relationship in the assembled condition of the hull sections to form a leak-proof joint between adjacent hull sections.

4 Claims, 14 Drawing Figures

FIG 10
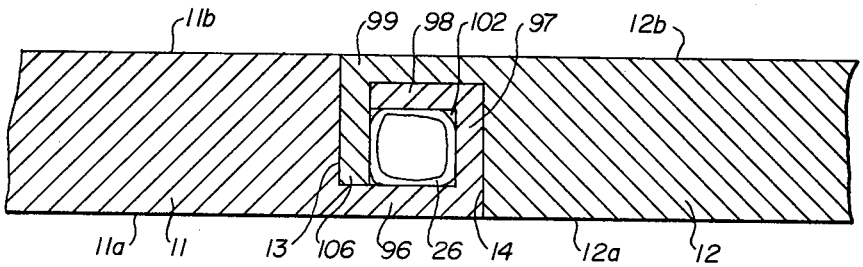
FIG 11
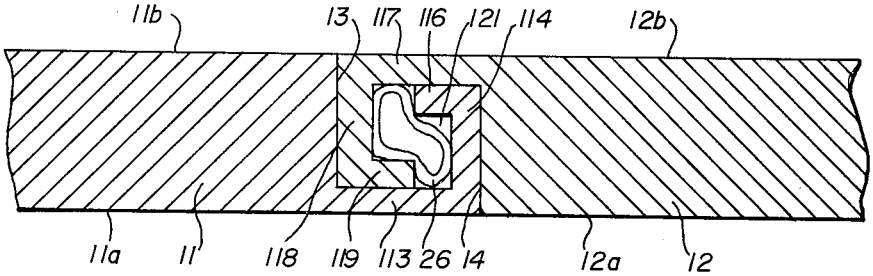
FIG 12
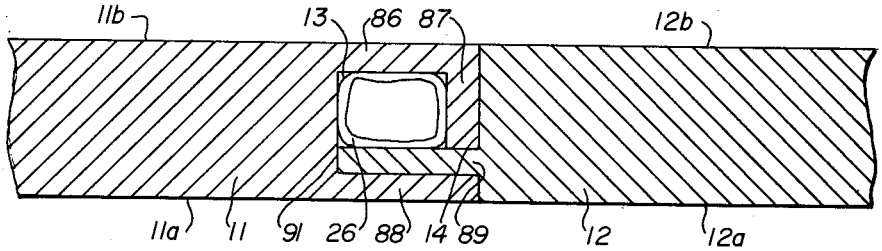
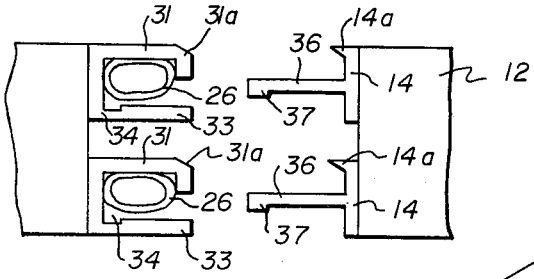
FIG 14
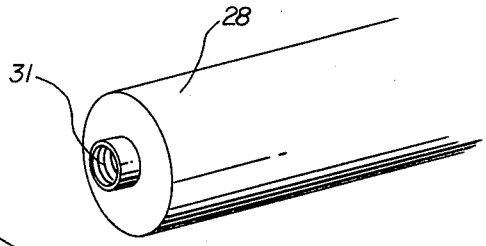
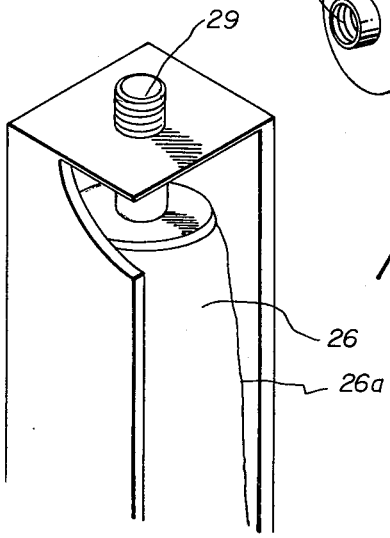
FIG 13

SECTIONAL BOAT JOINT CONSTRUCTION

BACKGROUND OF THE INVENTION

The advantages of a boat construction comprising a plurality of hull sections which may be assembled together and disassembled have long been recognized and many structures for such sectional boats have been proposed. Even though present day small boat construction advantageously utilizes various lightweight materials such as plastics and lightweight metals, a boat capable of transporting one or more persons is still an awkward load to move from a place of storage to a place of use both from the standpoint of size as well as weight. A boat which can be broken down into a plurality of sections and reassembled at the point of use provides many advantages including the ability of being able to be stored in a limited space and ready portability in the compact nested arrangement of the hull sections from which the boat is assembled. However, present day sectional boat construction is characterized by a basic problem in the type of joint utilized to interconnect the hull sections when the boat is assembled for use. In one type of present day sectional boat joint, use is made of watertight bulkheads on either side of the joint and a mechanical fastener of a suitable type is used to fasten the bulkheads together. The primary disadvantages of such a joint construction are the excessive interior space required by the bulkheads, their weight, high cost and complex construction and the structural difficulties caused by stresses normally carried in the side and bottom planking being channeled through the bulkhead to the mechanical fasteners. This causes high stress areas in the fasteners, bulkheads and bulkhead to hull joints requiring massive construction and adding further to the weight and cost. Joint constructions for sectional boats in use today are generally of a complex nature adding considerably to the weight of the boat and additionally requiring a somewhat skilled person to properly assemble and disassemble the boat. Furthermore, such present day joint constructions do not provide the desired degree of sealing. Even if adequate sealing is provided under normal conditions, the use of a typical sectional boat in severe weather conditions readily produces leaks in the sectional joints presenting a considerable hazard to the passengers in the boat. Many such present day joint constructions for sectional boats utilize parts which project from the joint limiting the mobility of the passengers in the boat. In addition, such present day boat joint constructions frequently require the use of special tools which are not always readily available at the point of use.

OBJECTS AND SUMMARY OF THE INVENTION

Accordingly, a primary object of this invention is to provide a new and novel joint construction for a sectional boat which permits the boat to be easily assembled and disassembled.

Another object of this invention is to provide a new and novel joint construction for a sectional boat which is simple and inexpensive in construction and which permits a relatively unskilled individual to easily make the necessary connections between the hull sections.

Still another object of this invention is to provide a new and novel joint construction for a sectional boat which adds very little to the weight of the boat, which may be adapted to the wide variety of boat types, which permits the use of a selected number of hull sections within a wide practical range and which permits the hull sections to be readily nested in a highly compact manner for storage, transportation and the like.

A still further object of this invention is to provide a new and novel joint construction for a sectional boat which permits the hull sections to be quickly and easily assembled and disassembled while providing complete sealing against the entry of water into the boat.

The objects stated above and other related objects are accomplished by the provision of a joint construction of a sectional boat assembled from a plurality of hull sections detachably connected together with each of the hull sections having a transversely extending edge portion arranged for longitudinally aligned engagement with the edge portion of an adjacent hull section in the assembled condition of the boat. Interlocking means are provided on the edge portions of the adjacent hull sections for detachably retaining the hull sections together, the interlocking means including outwardly extending flange means on each of the edge portions for mutual overlapping relationship in the assembled condition of the boat to define a transversely extending cavity therebetween At least one inflatable bladder having an outer wall is disposed within the cavity and means for inflating the bladder are provided to move the bladder outer wall into frictional gripping engagement with the overlapping flange means on the adjacent hull sections to retain the flange means in the overlapping relationship and to form a leak proof seam along the joint between the adjacent hull sections.

The invention will be better understood as well as further objects and advantages thereof become more apparent from the ensuing detailed description of the preferred embodiments taken in conjunction with the drawings.

BRIEF DESCRIPTION OF THE DRAWINGS

FIG. 10 is a sectional view of a ninth embodiment of the joint construction of the invention;

FIG. 11 is a sectional view of a tenth embodiment of the joint construction of the invention;

FIG. 12 is a sectional view of an eleventh embodiment of the joint construction of the invention;

FIG. 13 is a perspective view illustrating the inflatable bladder incorporating in the joint construction of the invention together with one form of a device for inflating such a bladder; and FIG. 14 is a sectional view of a twelfth embodiment of the joint construction of the invention.

DESCRIPTION OF THE PREFERRED EMBODIMENTS

Figure 1:
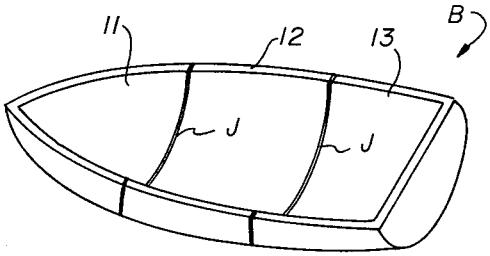
FIG. 1 is a perspective view of a sectional boat incorporating the joint construction of the invention.

Referring now to FIG. 1, there is shown a sectional boat designated generally by the letter B of conventional shape such as a dory or a dinghy. The sectional boat B shown in FIG. 1 includes a plurality of hull sections such as a bow section 11 an intermediate section 12 and a stern section 13. However, it should be understood that the sectional boat B of 1 may be formed from as few as two hull sections or as many as desired within a practical range. In accordance with the invention, the hull sections 11–13 are detachably interconnected by a joint designated generally by the letter J.

Figure 2:
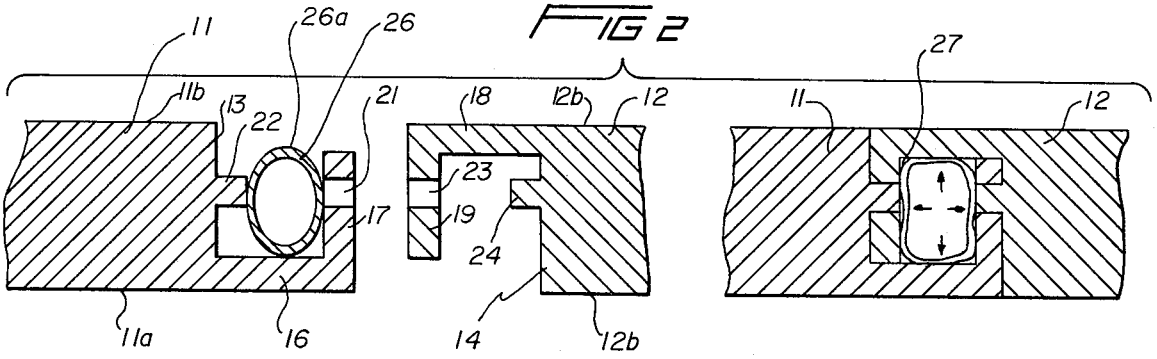
FIG. 2 is a sectional view of one embodiment of the joint construction of the invention.

Referring now to FIG. 2, there is shown one embodiment of the joint construction J utilized to interconnect the hull sections 11–13. As shown in FIG. 2, the joint J which, in the illustrated embodiment is disposed between hull section 11 and 12, includes a transversely extending edge portion 13 on the hull section 11 and a transversely extending edge portion 14 on the hull section 12. Interlocking means are provided for detachably retaining the hull sections 11, 12 together in the assembled condition of the boat which includes flange means extending outwardly from each of the edge portions 13, 14 for mutual overlapping relationship as shown in FIG. 2.

More specifically, the flange means on edge portion 13 includes a horizontally extending flange 16 extending outwardly from the edge portion 13 on one side 11*a* of the hull section 11 and a flange 17 extending vertically upward from the free end of the horizontal flange 16. Similarly, the flange means on the edge portion 14 includes a horizontally extending flange 18 extending outwardly on one side 12*b* of the hull section 12 and a flange 19 extending vertically downward from the horizontal flange 18.

The vertical flange 17 on the edge portion 13 includes at least one aperture 21 and the edge portion 13 includes at least one projection 22. The vertical flange 19 on the edge portion 14 includes at least one aperture 23 and a projection 24 is provided on the edge portion 14 of the hull section 12. At least one inflatable bladder 26, having an outer wall 26*a* preferably in the form of a tubular member as shown best in FIG. 13 is disposed within a cavity 27 defined by the flange means on each of the edge portions 13, 14 of the hull sections 11, 12 respectively when the hull sections are interconnected as shown in FIG. 2 in overlapping relationship.

Preferably, the inflatable bladder 26 is initially positioned within the opening adjacent the edge portion 13 within the flanges 16, 17 so that when the flange 19 on the edge portion 14 is inserted within the opening, the projection 22 is accommodated within the aperture 23 with simultaneous accommodation of the projection 24 in the aperture 21 on the vertical flange 17. The bladder 26 is seated between the adjacent surfaces defining the cavity 27. Inflation of the bladder 26 is accomplished by suitable means such as bicycle tire pump or a $CO_2$ cartridge 28, as shown in FIG. 13, utilizing a nipple 29 on the bladder 26 and a fitting 31 on the $CO_2$ cartridge 28. Upon inflation, the outer wall 26*a* of the bladder 26 is expanded into frictional gripping engagement with the adjacent surfaces of the flanges 16–19 (as shown by the arrows) to retain the flange means on the hull sections 11, 12 in the overlapping relationship shown in FIG. 2 forming a leakproof seam along the adjacent edge portions 13, 14.

Figure 3:
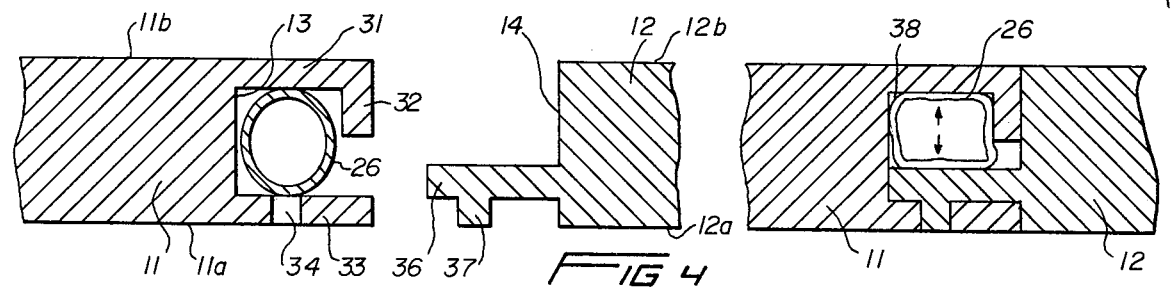
FIG. 3 is a sectional view of a second embodiment of the joint construction of the invention.

Referring now to FIG. 3, wherein like numerals identify like parts, there is shown a second embodiment of the joint construction of the invention. In the embodiment of FIG. 3, the edge portion 13 of the hull section 11 includes a horizontally extending flange 31 adjacent the side 11*b* of the hull section 11 on the outer end of which is provided a flange 32 extending vertically downward as shown. The edge portion 13 also includes a horizontally extending flange 33 adjacent the side 11*a* of the hull section 11 and the flange 33 is provided with an aperture 34 intermediate its ends. The flange means on the edge portion 14 of the hull section 12 includes a horizontally extending flange 36 having a downwardly extending projection 37 intermediate its ends. In the assembly of the joint of FIG. 3, the flange 36 on the edge portion 14 is inserted within the opening provided with the flanges 32, 33 on the hull section 11 after the inflatable bladder has been positioned therein. The flanges 32, 33 abut the edge portion 14 of the hull section 12 and the projection 37 is received within the aperture 34 of the flange 33. Thus, the overlapping flange means on the edge portion 13, 14 define a cavity 38 so that when the bladder 26 is inflated, the overlapping flange means are maintained in the engaged overlapping position as shown in the right-hand side of FIG. 3 to form a leak proof joint J.

Figure 4:
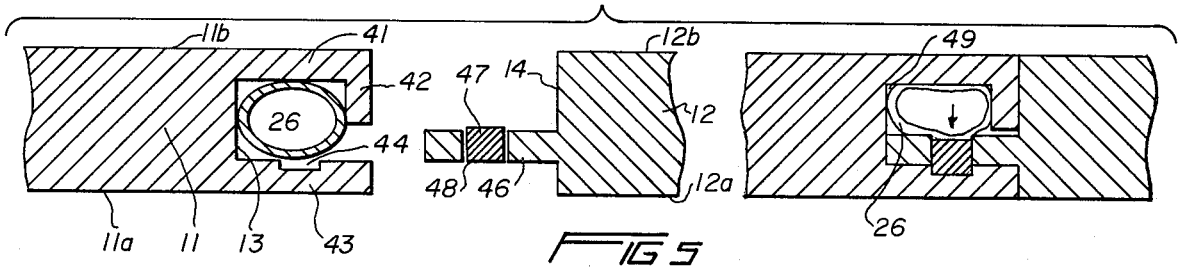
FIG. 4 is a sectional view of the third embodiment of the joint construction of the invention.

FIG. 4 shows a third embodiment of the invention, wherein like numerals are used to identify like parts. In the embodiment of FIG. 4, the edge portion 13 of the hull section 11 is provided with flange means which include a horizontal flange 41 on the outer end of which is provided a flange 42 extending vertically downward adjacent the side of 11*b* of the hull section 11. A horizontally extending flange 43 having a recess 44 is provided on the edge portion 13 adjacent the side 11*a* of the hull section 11. The edge section 14 of the hull section 12 is provided with a horizontally extending flange 46 adjacent the side 12*a* of the hull section 12 and the flange 46 is provided with a aperture 47 in which a movable locking member 48 is loosely positioned. In the joint construction of FIG. 4, and subsequent to the insertion of the bladder 26 between the flanges 41, 43 of the hull section 11, the flange 46 on the hull section 12 is inserted through the opening between the flanges 42, 43 on the hull section 11. Subsequently, the bladder 26 disposed in the cavity 49 is inflated and the outer wall 26*a* of the bladder 26 engages the locking member 48 moving it into the recess 44 to maintain the flange means on the hull section 11, 12 in the overlapping relationship to form a leak proof joint J.

Figure 5:
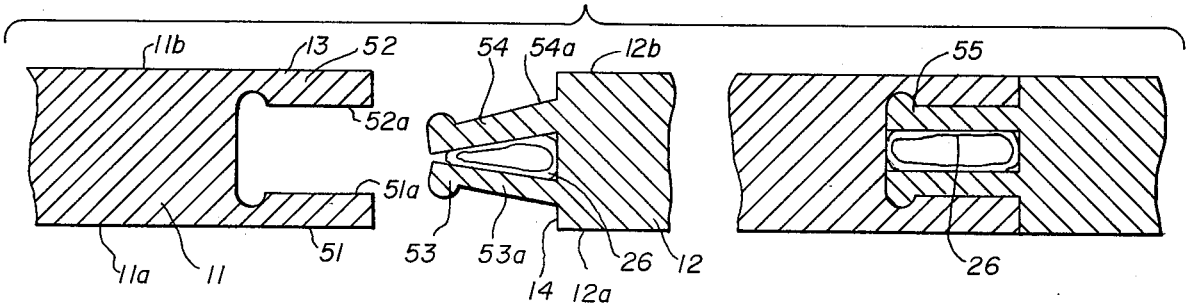
FIG. 5 is a sectional view of a fourth embodiment of the joint construction of the invention.

FIG. 5 shows a third embodiment of the invention wherein like numerals are used to identify like parts. In the embodiment of FIG. 5, the edge portion 13 on the hull section 11 is provided with horizontally extending flanges 51, 52 adjacent the sides 11*a*, 11*b* respectively of the hull section 11 and the outer ends of the flanges 51, 52 are provided with hooks 51*a*, 52*a* respectively. The edge portion 14 of the hull section 12 is also provided with a pair of spaced-apart hook members 53, 54 having recesses 53*a*, 54*a* respectively so that hook members 53, 54 are relatively flexible. A bladder 26 is positioned between the hook sections 53, 54 and the hook section 53, 54 are inserted within the opening defined by the pair of spaced-apart flanges 51, 52 as shown in FIG. 5. Upon inflation of the bladder 26, the hook member 53, 54 expand outwardly with the hooks 51*a*, 52*a* being received within the notches 53*a*, 54*a* respectively of the hook member 53, 54 so that the bladder 26 disposed within a cavity 55 spreads the hook members 53, 54 apart into retaining engagement forming the leak proof joint of the invention.

Figure 6:
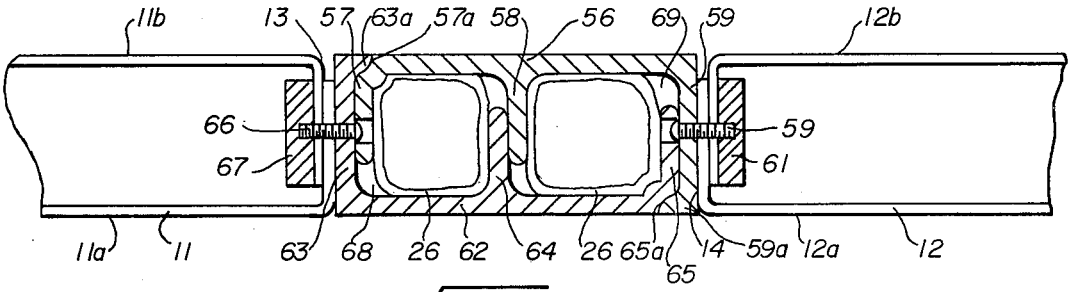
FIG. 6 is a sectional view of the fifth embodiment of the joint construction of the invention.

In the embodiment of FIG. 6, wherein the fifth embodiment of the invention is shown, the flange means on each of the hull sections 11, 12 are separately formed and means are provided for detachably connecting the flange means to each of the hull sections 11, 12. Most specifically, the flange means on hull section 12 include a horizontally extending flange 56 having a plurality of longitudinally spaced flanges 57, 58 and 59 arranged in longitudinally spaced relationship. The flange means for hull section 12 is detachably mounted on the edge portion 14 of the hull section 12 by means of a screw 59 engageable with a threaded recess in a mounting block 61 secured to the hull section 12 adjacent the edge portion 14. Similarly, the flange means on the hull section 11 includes a horizontally extending flange 62 and a plurality of longitudinally spaced and vertically extending flanges 63–65 The flange means for the hull section 11 is similarly secured to edge portion 13 by means of screw 66 which extends through vertical flange 63 in threaded engagement with suitable recess in a mounting block 67 secured to hull section 11 adjacent the edge portion 13. In the assembled position of FIG. 6, the flanges 63–65 overlap the flanges 57–59 and define therebetween a pair of cavities 67–69 in each of which a bladder 26 are disposed. When the bladders 26 are inflated, the flanges forming the flange means of each of the hull sections 11, 12 are maintained in the overlying relationship shown to form the leakproof point J of the invention. Preferably, small projecting ledges 59*a*, 63*a* are provided on flanges 59, 63 which are arranged to seat in recesses 57*a*, 65*a* respectively which prevent the joint J from distorting when the interior bladders 26 are pressurized. Similarly, in the embodiment of FIG. 7, a small projecting ledge 14*a* is provided on the edge portion 14 which mates with a recess 73*a* in the corner between horizontal flange 73 and vertical flange 76.

Figure 7:
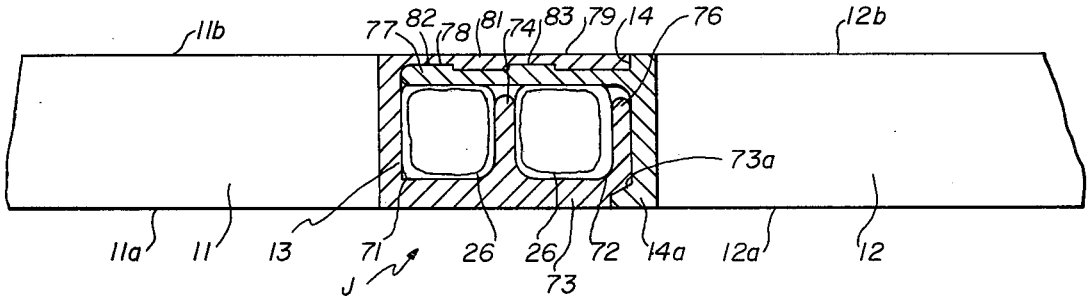
FIG. 7 is a sectional view of a sixth embodiment of the joint construction of the invention.

Referring now to FIG. 7, which illustrates a sixth embodiment of the joint construction of the invention and wherein like numerals are used to identify like parts, the joint construction J is provided with a pair of cavities 71, 72 each of the cavities 71, 72 being provided with an inflatable bladder 26. In the embodiment of FIG. 7, the flange means for hull section 11 includes a horizontally extending flange 73 adjacent the side 11*a* of the hull section 11 and a pair of longitudinally spaced vertically extending flanges 74, 76 formed integrally with the flange 73. On the edge portion 14 of the hull section 12, there is provided a horizontally extending flange 77 adjacent the side 12*b* of the hull section 12 the flange 77 being provided with a pair of projections 78, 79 as shown. The flange means on the hull section 11 also includes a horizontally extending flange 81 adjacent the side 11*b* of the hull section 11 and the flange 81 is provided with a pair of notches 82, 83 spaced similarly to the projections 78, 79 respectively on the flange 77 for the hull section 12. In the assembly of the hull sections 11, 12 the flange means on the hull sections are interconnected in the overlapping relationship shown in FIG. 7 with the bladders 26 disposed within the cavities 71, 72 formed thereby and the bladders inflated to maintain the overlapping flange means in the assembled relationship of FIG. 7 to form the leakproof joint J of the invention.

Figure 8:
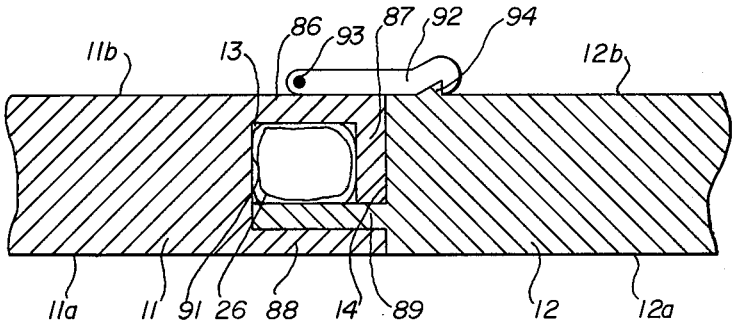
FIG. 8 is a sectional view of a seventh embodiment of the joint construction of the invention.

In the embodiment of FIG. 8, wherein like numerals are used to identify like parts, the edge portion 13 of the hull section 11 includes a horizontally extending flange 86 and a vertically extending flange 87 on the free end thereof adjacent the side 11*b* of the hull section 11. A horizontally extending flange 88 is also provided on the edge portion 13 adjacent the hull section side 11*a* somewhat similar to the embodiment of FIG. 3. The edge portion 14 of the hull section 12 includes a horizontally flange 89 adjacent the side 12*a* which is arranged to be received as shown in FIG. 8 between the flanges 87 and 88 subsequent to the placement of the bladder 26 in the cavity 91 defined thereby. In addition, latch means are provided for supplementing the locking action of the joint construction which includes a hook 92 pivotally mounted at 93 on the hull section 11. The hook 92 is arranged to be pivoted downwardly into locking engagement with a detent 94 on the hull section 12 so that inflation of the bladder 26 in the cavity 91 and the engagement of the hook 92 with the detent 94 forms the leakproof joint in the embodiment of FIG. 8.

Figure 9:
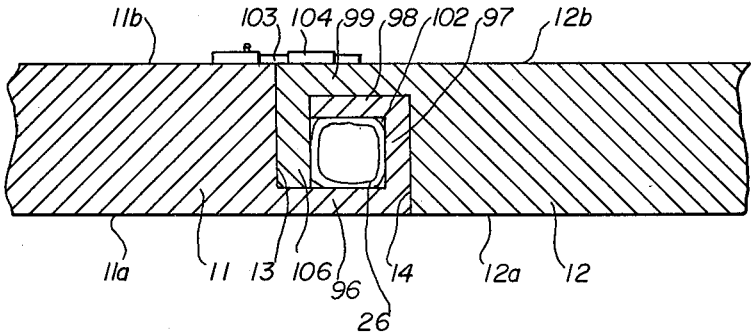
FIG. 9 is a sectional view of a eighth embodiment of the joint construction of the invention.

In the embodiment of FIG. 9, wherein like numerals are used to identify like parts, the edge portion 13 of the hull section 11 is provided with a horizontally extending flange 96 adjacent the side 11*a* on the outer end of which are provided a pair of flanges 97, 98 in an L shaped configuration. The edge portion 14 of the hull section 12 includes flange means of L-shaped configuration comprising a horizontally extending flange 99 adjacent the side 12*b* of the hull section 12 and a downwardly extending flange 101 on the outer end thereof. The flange means on the hull sections 11, 12 are assembled together with a bladder 26 therebetween disposed in a cavity 102 formed by the flange means and subsequently inflated to retain the flange means in the locking position shown. In addition, locking means are also provided on the embodiment of FIG. 9 similar to the embodiment of FIG. 8 which includes a slidable bolt 103 positioned for sliding movement on the hull section 11 and arranged to engage a keeper 104 suitably mounted on the side 12*b* of the hull section 12.

In the embodiment of FIG. 10, the flange means for the hull sections 11, 12 are identical to the embodiment of FIG. 9 except that the supplemental locking means in the form of the sliding bolt 103 are not employed. Therefore, identical numerals are used to identify the same parts in FIG. 10 as that of the embodiment of FIG. 9.

FIG. 11 illustrates the tenth embodiment of the joint construction of the invention wherein like numerals are used to identify like parts. In the embodiment of FIG. 11, the flange means on the edge portion 13 of the hull section 11, includes a horizontally extending flange 113 adjacent the side 11*a* of the hull section 11 and the outer end of the flange 113 is provided with a pair of flanges 114, 116 in a L-shaped configuration. Similarly, the edge portion 14 of the hull section 12 includes a horizontally extending flange 117 adjacent the side 12*b* of the hull section 12 and the outer end of the flange 117 includes flanges 118, 119 in an L-shaped configuration as shown. In the assembled embodiment of the joint construction of FIG. 11, the flanges 114, 118 abutt the edge portion 13, 14 and with the bladder 26 disposed within the cavity 121 defined by the overlapping flange means the flange means are maintained in the overlying relationship to form the leakproof joint of the invention.

In the embodiment of FIG. 12, wherein like numerals are used to identify like parts, the hull sections 11, 12 are provided with flange means identical to the embodiment of FIG. 8 without the use of the supplemental locking means or latch 92. Therefore, identical reference numerals have been used to identify the embodiment of FIG. 12.

It should be understood that it is within the scope of the invention to use more than one of the previously described joint constructions at each joint J. By way of example, there is shown in FIG. 14, such a joint utilizing a pair of joint constructions of the type shown in FIG. 3 wherein like numerals are used to identify like parts. In addition, small projecting ledges 14*a* are provided on edge portions 14 which mate with beveled corners 31*a* between horizontal flanges 31 and vertical flange 32 for the same purpose as described above with reference to the embodiments of FIGS. 6, 7.

What is claimed is:

1. A joint construction for a sectional boat comprising, in combination, a plurality of boat hull sections adapted to be detachably connected together in an assembled condition to form a boat, each of said hull sections having a transversely extending edge portion for engagement in longitudinally aligned relationship with the edge portion of the adjacent hull section in the assembled condition of said boat, interlocking means on said hull edge portions for detachably retaining said hull sections together in said assembled condition, said interlocking means including outwardly extending flange means on each of said edge portions for mutual overlapping relationship in said assembled condition to define a transversely extending cavity therebetween, at least one inflatable bladder having an outer wall disposed within said cavity and means for inflating said at least one bladder to move said bladder outer wall into frictional gripping engagement with both of said flange means to retain said flange means in said overlapping relationship and to form a leakproof seam between said adjacent hull sections, said flange means, when forced into contact by the inflation of said bladder, acting as the primary structural connection between said adjacent hull sections wherein said interlocking means include at least one projection and at least one aperture in corresponding positions on said adjacent hull sections, the disposition of said projection and aperture being such that, the inflation of said bladder positioning said projection within said aperture, said projection and aperture lock said hull sections against relative motion.

2. A joint construction in accordance with claim 1 wherein said flange means on the edge portion of one of said adjacent hull sections include a flange extending horizontally outward from one side of said one hull section and a flange extending vertically upward from the free end of said horizontal flange, said flange means on the edge portion on the other of said adjacent hull sections including a flange extending horizontally outward from the opposite side of said other hull section and a flange extending vertically downward from the free end of said horizontal flange, said vertical flange on each of said edge portions being arranged from abutting engagement with the other of said edge portions in said overlapping relationship, said at least one aperture in each of said vertical flanges, said at least one corresponding projection on each of said edge portions for accommodation within said aperture in the vertical flange on the other of said edge portions thereby locking said hull sections together against relative vertical movement in the inflated condition of said bladder.

3. A joint construction in accordance with claim 1 wherein said flange means on the edge portion of one of said adjacent hull sections comprises a flange extending horizontally outward from said edge portion intermediate the sides of said one hull section, said at least one projection extending perpendicular from said horizontal flange, said flange means on the edge portion of the other of said adjacent hull sections including a pair of spaced-apart flanges extending horizontally outward on opposite sides of said other hull section to define an opening, said at least one aperture in one of said pair of horizontal flanges, said opening being arranged to accommodate said horizontal flange on said one hull section with said horizontal flange in overlying relationship with one of said pair of horizontal flanges and with said at least one projection extending within said at least one aperture, said horizontal flange on said one hull section defining with the other of said pair of horizontal flanges said cavity for accommodating said bladder.

4. A joint construction in accordance with claim 1 wherein said flange means on the edge portion of one of said adjacent hull sections comprises a flange extending horizontally outward from said edge portion intermediate the sides of said one hull section, one of said at least one aperture in said horizontal flange, said projection movably mounted in one of said at least one aperture, said flange means on the edge portions of the other of said adjacent hull sections including a pair of spaced-apart flanges extending horizontally outward on opposite sides of said other hull section to define an opening, another of said at least one aperture in one of said pair of horizontal flanges, said opening being arranged to accommodate said horizontal flange on said one hull section with said horizontal flange in overlying relationship with said one of said pair or horizontal flanges, said horizontal flange on said one hull section defining with the other of said pair of horizontal flanges said cavity for accommodating said bladder, said bladder in the inflated condition engageable with said projection to move said projection into another of said at least one aperture for locking said horizontal flanges together.

* * * * *